US010905273B2

(12) United States Patent
Locklear

(10) Patent No.: US 10,905,273 B2
(45) Date of Patent: Feb. 2, 2021

(54) DRAPERY-HOLDING, LIGHT BLOCKING AIR DEFLECTOR

(71) Applicant: Edward Darrin Locklear, Hollywood, FL (US)

(72) Inventor: Edward Darrin Locklear, Hollywood, FL (US)

( * ) Notice: Subject to any disclaimer, the term of this patent is extended or adjusted under 35 U.S.C. 154(b) by 283 days.

(21) Appl. No.: 16/020,542

(22) Filed: Jun. 27, 2018

(65) Prior Publication Data

US 2019/0000257 A1 Jan. 3, 2019

Related U.S. Application Data

(60) Provisional application No. 62/526,946, filed on Jun. 29, 2017.

(51) Int. Cl.

| | |
|---|---|
| ***A47H 21/00*** | (2006.01) |
| ***E06B 7/26*** | (2006.01) |
| *F24F 13/08* | (2006.01) |
| *E06B 9/36* | (2006.01) |

(52) U.S. Cl.

CPC ..... *A47H 21/00* (2013.01); *E06B 7/26* (2013.01); *E06B 9/367* (2013.01); *F24F 13/084* (2013.01)

(58) Field of Classification Search

CPC . E06B 9/367; E06B 9/365; E06B 7/26; F24D 19/06; F24D 19/062; A47H 23/01; A47H 21/00; F24F 13/084

See application file for complete search history.

(56) References Cited

U.S. PATENT DOCUMENTS

| | | | | | |
|---|---|---|---|---|---|
| 507,520 | A | * | 10/1893 | Amos | E06B 7/26 454/216 |
| 903,266 | A | * | 11/1908 | Atkinson | F24D 19/06 237/79 |
| 948,417 | A | * | 2/1910 | Dunlap | E06B 7/26 454/220 |
| 1,012,111 | A | | 12/1911 | Swedlund et al. | |
| 1,654,002 | A | * | 12/1927 | Kleinhamer | A47H 19/00 160/349.2 |
| 1,955,476 | A | | 4/1934 | Torgersen | |
| 2,043,815 | A | * | 6/1936 | Smith | E06B 7/26 454/220 |
| 2,107,421 | A | | 2/1938 | Lennox | |
| 2,153,893 | A | * | 4/1939 | Johanson | A47L 4/04 15/257.01 |

(Continued)

*Primary Examiner* — Daniel P Cahn
*Assistant Examiner* — Abe Massad
(74) *Attorney, Agent, or Firm* — John Rizvi; John Rizvi, P.A.—The Patent Professor

(57) ABSTRACT

A drapery-holding, light-blocking air deflector is provided comprising an elongated deflector housing having an internal space. A rod is mounted for rotation within the internal space of the deflector housing. Multiple retaining radial protrusions (e.g., radially extending flaps) are mounted on the rod. The rod can be rotated in the internal space of the deflector housing to orient the retaining radial protrusions at multiple positions or angles and retain a curtain or other suspended light-blocking or privacy item within the internal space. Thus, the air deflector prevents the curtains, panels or other suspended, light-blocking or privacy items from being blown forward by air from an AC unit and separating and unblocking light passing through a window into the room.

17 Claims, 11 Drawing Sheets

(56) References Cited

U.S. PATENT DOCUMENTS

| | | | | | |
|---|---|---|---|---|---|
| 2,205,156 | A * | 6/1940 | Rowley | E06B 9/325 | 160/174 R |
| 2,293,883 | A | 8/1942 | Bossert | | |
| 2,559,072 | A | 7/1951 | Hasselwander | | |
| 2,612,220 | A * | 9/1952 | Turkowski | E06B 9/36 | 160/168.1 V |
| 3,269,551 | A | 8/1966 | Hertzel | | |
| 3,665,969 | A | 5/1972 | Clifford | | |
| 5,195,869 | A | 3/1993 | Groenhoff | | |
| 5,282,514 | A * | 2/1994 | Felcetto | E06B 9/325 | 160/172 R |
| 5,316,065 | A * | 5/1994 | Alligood | E06B 9/0638 | 160/170 |
| 5,454,755 | A * | 10/1995 | Sweeny | E06B 7/03 | 454/216 |
| 6,443,208 | B1 * | 9/2002 | Win | E06B 9/063 | 160/172 V |
| 2005/0230061 | A1 * | 10/2005 | Wilkins | E06B 9/0653 | 160/172 R |
| 2013/0062023 | A1 | 3/2013 | Little | | |
| 2014/0053992 | A1 | 2/2014 | Romero et al. | | |
| 2014/0076506 | A1 | 3/2014 | Olivas | | |

* cited by examiner

DRAPERY-HOLDING, LIGHT BLOCKING AIR DEFLECTOR

CROSS-REFERENCE TO RELATED APPLICATIONS

This application claims the benefit of U.S. Provisional Patent Application Ser. No. 62/526,946, filed on Jun. 29, 2017, which is incorporated by reference herein in its entirety.

FIELD OF THE INVENTION

The present invention relates generally to curtains and draperies. More particularly, the present invention relates to a drapery-holding, light-blocking air deflector which secures and prevents curtains, panels or other light-blocking items suspended above an air-conditioning (AC) unit, such as an AC unit in a hotel or motel room, from being blown away from a window and allowing light to pass into the room.

BACKGROUND OF THE INVENTION

Lodging rooms such as hotel and motel rooms typically include a set of one or more curtains, panels or other suspended items covering a window and preferably capable of fully concealing the window and blocking all light from entering the room. Often, hotel and motel rooms further include an air-conditioning (AC) unit arranged beneath the room window and window curtains, in such a way that a bottom end of the window curtains, generally known as curtain hem, is relatively close to the top of the AC unit. The AC unit includes an outlet vent which normally blows air forwardly and upwardly into the room.

Because the curtain hem is arranged near the top of the AC unit, the flowing air blown by such AC unit typically blows the curtains forward from the window. In consequence, the curtains have a tendency to sway forward and separate from the window, causing an increased and undesired gap to be formed between the curtain hem and the window. Light is often able to pass through this gap and penetrate the room. The incoming light may have an adverse effect on the ability of room occupants to sleep, particularly if the occupants are sensitive to light.

The room occupants may choose to turn the AC unit down or off to prevent normal operation of the AC unit from causing the curtain not to be effective in blocking light from entering the room. However, switching the AC unit down or off may then cause the occupants to feel excessively cold or hot, depending on the outside temperature.

Accordingly, there is an established need for some type of solution that allows window curtains, panels or other suspended light-blocking items and AC units to coexist in the vicinity of a window of a room, so that a room occupant can benefit from simultaneously using the AC unit for air-conditioning purposes and using the light-blocking items for light-blocking purposes.

SUMMARY OF THE INVENTION

The present invention is directed to an air deflector which can be installed between an AC unit and a set of one or more window curtains, panels or other suspended light-blocking or privacy items (hereinafter referred to generally as curtains) in a room, such as a hotel or motel room. The air deflector includes a deflector housing which is attached to the wall above the AC unit and beneath the curtains. The deflector housing is opaque and includes a top opening through which a hem or bottom end of the curtains is received. A rod may be mounted within the internal space of the deflector housing. Multiple retaining radial protrusions (e.g., radially extending flaps) may be mounted on the rod. The rod may be adjustable to multiple positions within the internal space of the deflector housing. Accordingly, the retaining radial protrusions can be placed at any of various angles within the internal space to engage and retain the curtains within the deflector housing. The deflector housing blocks, deflects and prevents the curtains from being blown forwardly or outwardly from the wall, separating and exposing the window. Thus, the air deflector maintains the curtains in a closed position and prevents light from passing through the window and into the room.

In a first implementation of the invention, a drapery-holding, light-blocking air deflector comprises an opaque, elongated deflector housing having a rear side configured to be attached to a wall, an opaque bottom, an opaque front and opaque side walls delimiting an internal space of the deflector housing. The deflector housing and internal space are elongately formed along a left-to-right, transverse direction and the internal space terminates in an elongate top opening extending along the transverse direction. Air deflector further includes a rod mounted along the transverse direction for rotation within the internal space of the deflector housing about a longitudinal axis of the rod. At least one retaining radial protrusion is mounted on the rod. The at least one retaining radial protrusion can be rotationally arranged at multiple rotational positions in relation the longitudinal axis of the rod. In these multiple radial positions, the at least one retaining protrusion is oriented towards the rear side of the deflector housing and at different angles with the elongate top opening.

In a second aspect, the deflector housing can be configured to adopt an assembled position in which the rear side of the deflector housing is attached to a wall and the top opening is oriented upward for receiving a bottom end of a hanging drapery therethrough and inside the internal space of the deflector housing. In the assembled position, the at least one retaining radial protrusion is rotationally adjusted to a rotational position in which the at least one retaining radial protrusion contacts the bottom end of the hanging drapery to limit or prevent a frontward movement of the bottom end of the hanging drapery relative to the rear side of the deflector housing.

In another aspect, an outer surface of the opaque front of the deflector housing can be sloped forward to reflect air impacting the deflector housing from below such that the air is reflected frontward of the deflector housing.

In another aspect, the deflector housing can include a housing bottom panel providing the opaque bottom, housing side panels extending from the housing bottom panel and providing the opaque side walls, and a front housing panel extending from the housing bottom panel between the housing side panels and providing the opaque front. In some embodiments, the front housing panel can be sloped frontward to reflect air coming from beneath the front housing panel in a frontward direction. Alternatively or additionally, the rod can be mounted for rotation between the housing side panels of the deflector housing.

In another aspect, the air deflector can further include a user-operable handle connected to the rod and arranged outside the deflector housing to facilitate manual rotation of the rod and positioning of the at least one retaining radial protrusion in any of the multiple rotational positions within the internal space of the deflector housing.

In another aspect, the rear side of the deflector housing can include a pair of housing attachment flanges extending transversely from opposite ends of the rear side and configured to rest on a wall. In some embodiments, each housing attachment flange can include at least one fastener opening extending through the housing attachment flange.

In another aspect, the at least one retaining radial protrusion can include a plurality of radial protrusions extending radially outward from the rod in a spaced-apart relationship with one another along a direction parallel to the longitudinal axis of the rod. In some embodiments, the radial protrusions can be aligned with one another along a direction parallel to the longitudinal axis of the rod.

In another aspect, the radial protrusion can be shaped as a flap.

In another aspect, the at least one retaining radial protrusion can be integrally formed with the rod into a single-piece unit.

In another aspect, each retaining radial protrusion of the at least one radial protrusion can include a rod sleeve through which the rod extends to mount the each retaining radial protrusion on the rod. In some embodiments, the rod sleeve can be mounted on the rod in a non-rotational relationship with the rod by insertion of at least one internal protuberance extending from the rod sleeve into at least one respective groove formed longitudinally in the rod.

In another aspect, the air deflector can further include at least one rod holder which engages the deflector housing and comprises a through opening through which the rod extends to additionally secure the rod in the internal space of the deflector housing. In some embodiments, each rod holder is clipped to a front housing flange, wherein the front housing flange extends rearward from the opaque front of the deflector housing and is adjacent to the elongate top opening. The front housing flange can be opaque and may further delimit the internal space of the deflector housing.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will be hereinafter described in conjunction with the appended drawings provided to illustrate and not to limit the invention, where alike designations denote like elements, and in which.

Like reference numerals refer to light parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
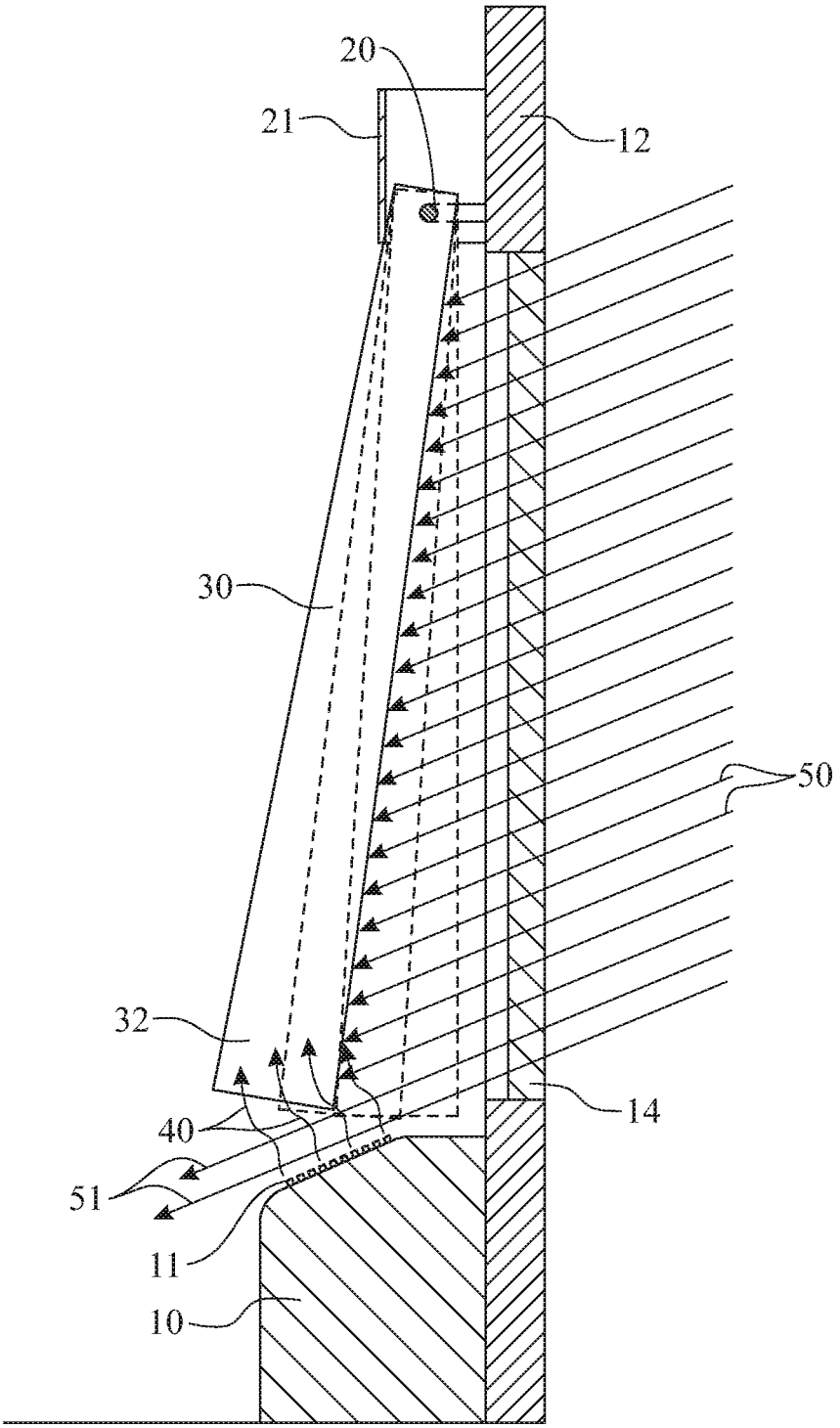
FIG. 1 (Prior Art)
FIG. 1 presents a cross-sectional side elevation view of a curtain and air-conditioning (AC) unit installation of the prior art, more particularly illustrating how the air exhausted from the AC unit blows the curtains forwardly or outwardly from the wall, and a hem or bottom end of the curtains is thus unable to block light from penetrating a room through a window.

Referring initially to FIG. 1, in hotel and motel rooms and other lodging rooms and the like, an air-conditioning (AC) unit 10 is typically installed against a wall 12 of the room. At least one window 14 is typically installed in the wall 12. A bracket 20 is typically installed on the wall 12 above the window 14. A set of one or more light-blocking items, such as but not limited to a set of one or more curtains 30 as depicted herein, a set of one or more panels (e.g. one-way directional panels), not shown, or a combination thereof, is suspended from the bracket 20 in front of the window 14 and above the AC unit 10. For clarity purposes, the set of one or more light-blocking items is hereinafter referred to generally as curtains 30. A soft valance or cornice board 21 is installed in front of the bracket 20 and the top of the curtains 30, to reduce or prevent light from shining above the curtains 30 and penetrating the room therefrom. The AC unit 10 heats or cools air, and blows the heated or cooled air 40 typically in an upward, and optionally also forward, trajectory against a bottom end 32 of the curtains 30 (the bottom end 32 often provided with a hem), causing the curtains 30 to sway forward as indicated in the drawing with broken lines. The air 40 blowing the curtains 30 forwardly into the room causes the curtains 30 to separate from the window 14 and allow bottom rays of light 51 to stream past the bottom end 32 of the curtains 30 entering the room, as shown in the figure. The light 51 entering the room may disturb occupants of the room at any time of the day. In addition, in some applications, the curtains 30 may be sufficiently long that the bottom of the curtains 30 tends to block the outlet vent 11 of the AC unit 10.

Figure 2:
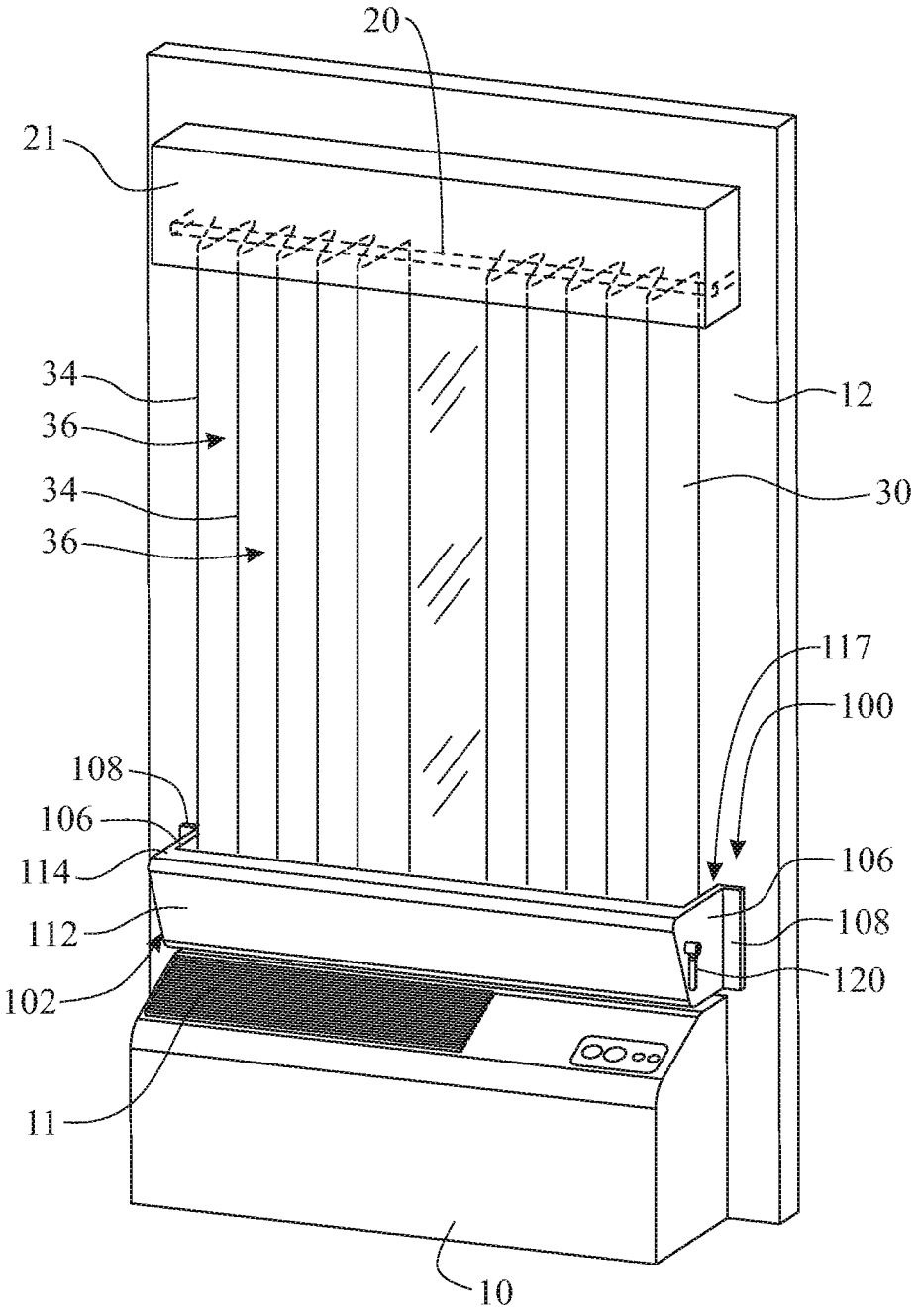
FIG. 2 presents a front perspective view of an air deflector in accordance with a first exemplary embodiment of the invention, shown installed on a wall beneath a set of curtains and above an AC unit.
Figure 3:
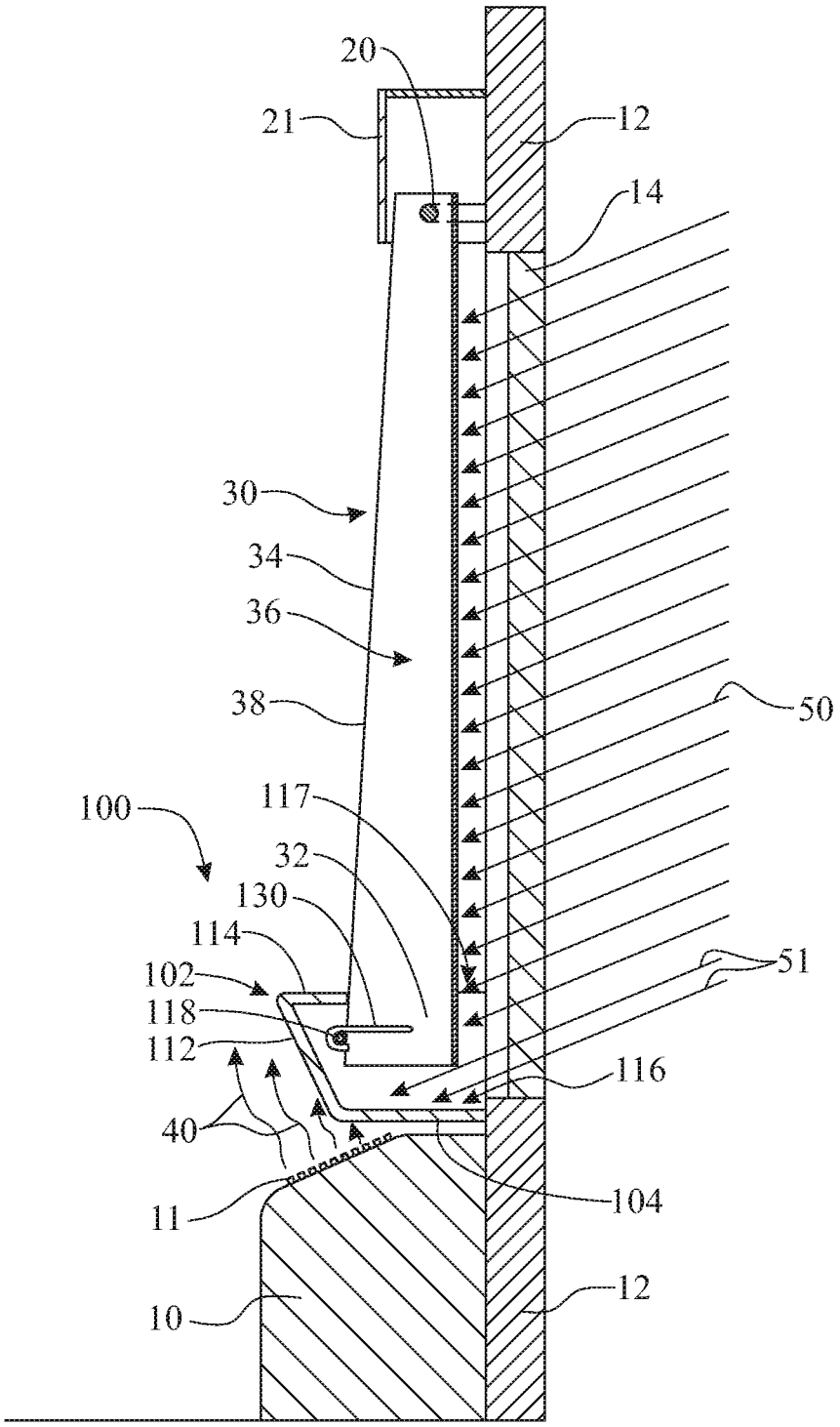
FIG. 3 presents a cross-sectional side elevation view of the air deflector, curtains and AC unit illustrated in FIG. 2, more particularly illustrating the air deflector blocking air from the AC unit from the curtains and light being blocked by the curtains and the air deflector.

The present invention is directed toward an air deflector which can be installed between an air-conditioning (AC) unit and a set of one or more window curtains or other suspended light-blocking items in a room such as, but not limited to, a hotel or motel room. For clarity purposes, the set of one or more light-blocking items is hereinafter referred to generally as curtains. The illustrations of FIGS. 2 through 8 show an exemplary embodiment of the air deflector of the present disclosure. With reference initially to FIGS. 2 and 3, the air deflector 100 may be mounted on the wall 12 just above the AC unit 10 and beneath the curtains 30, for which the curtains 30 may have been previously cut or adjusted to a shorter length than that of FIG. 1, in order to leave space for the air deflector 100 to be installed between the bottom edge 32 of the curtains 30 (the bottom edge 32 provided or not with a hem) and the AC unit 10. As will be explained in greater detail hereinafter, the air deflector 100 retains and prevents the air 40 (FIG. 3) which is ejected from the AC unit 10 from blowing the curtains 30 forwardly into the room, and thus prevents light from stream through the window 14 into the room when the AC unit 10 is blowing air.

Figure 4:
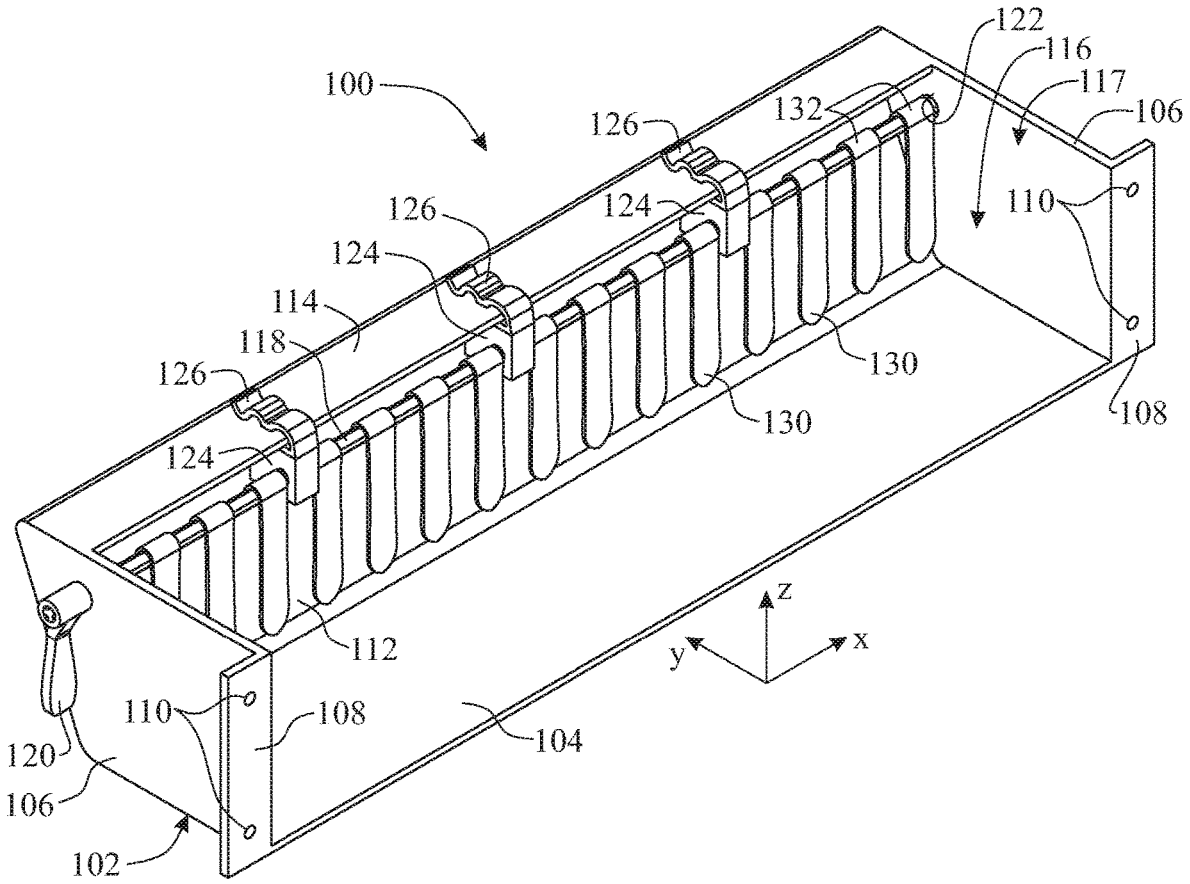
FIG. 4 presents a top rear perspective view of the assembled air deflector, with the retaining flaps shown in a first rotational position in the internal space of the deflector housing.

As particularly illustrated in FIGS. 4 through 8, the air deflector 100 may include a deflector housing 102. The deflector housing 102 may be generally elongated in shape along a transverse direction x, with a housing bottom panel 104, a pair of spaced-apart housing side panels 106 extending from respective ends of the housing bottom panel 104 and a front housing panel 112 extending from the housing bottom panel 104 between the housing side panels 106. In some embodiments, the housing bottom panel 104 may be configured to be arranged horizontally when the air deflector 100 is installed on a wall 12. In some embodiments, a pair of housing attachment flanges 108 may extend from the respective housing side panels 106. As best shown in FIG. 4, the housing attachment flanges 108 may be perpendicular to the housing bottom panel 104 such that the housing attachment flanges 108 are vertically disposed (and configured to rest against a vertical wall 12) while the housing bottom panel 104 is horizontally disposed. Fastener openings 110 may extend through the housing attachment flanges 108. Fasteners (not illustrated) may be extended through the respective fastener openings 110 and threaded into registering openings (not illustrated) in the wall 12 to secure the deflector housing 102 to the wall 12. Alternative techniques known by those skilled in the art may be used, however, to attach the deflector housing 102 to the wall 12.

Figure 8:
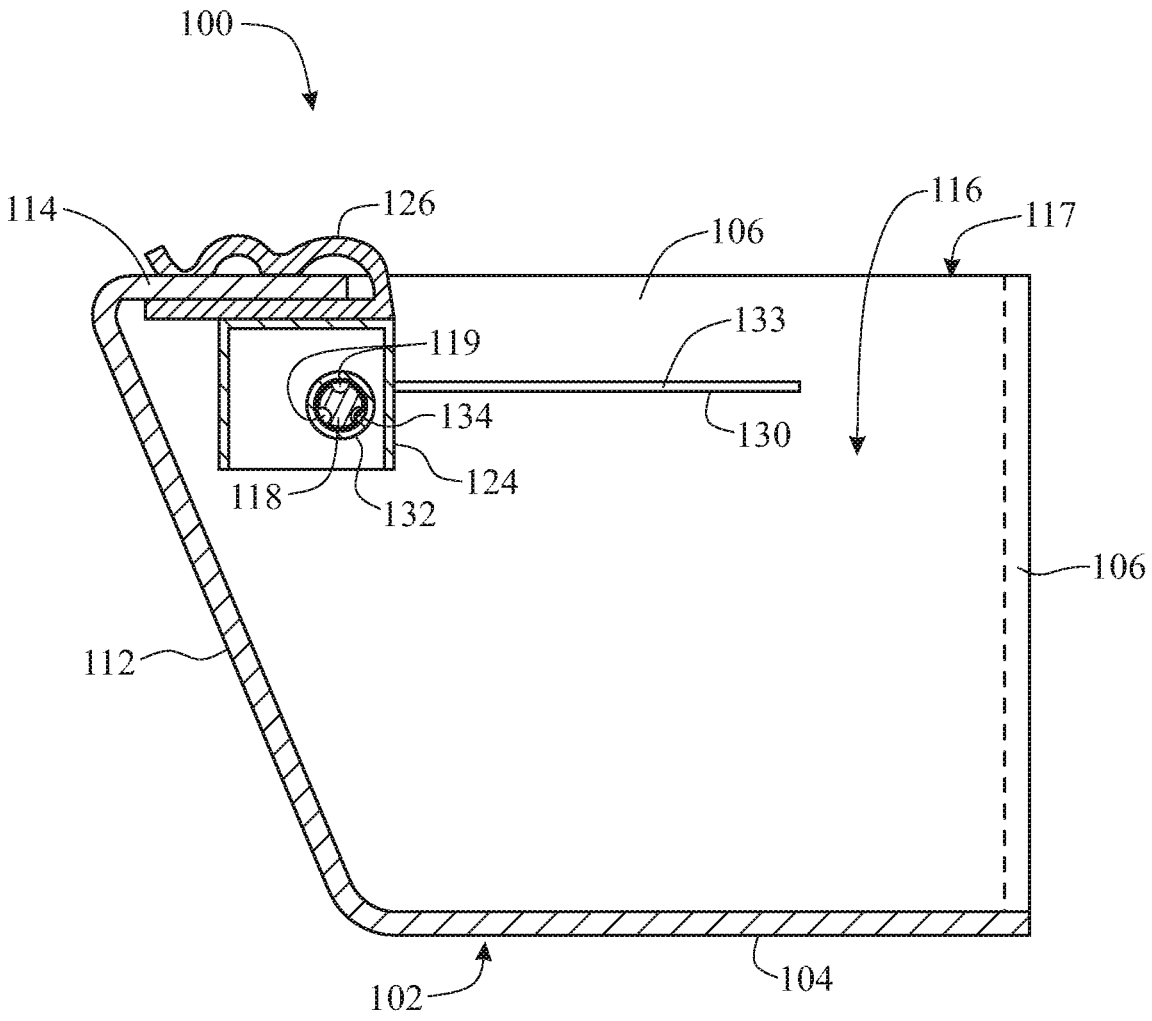
FIG. 8 presents a cross-sectional side elevation view of the air deflector, taken along a section plane indicated by line 8-8 in FIG. 6, the cross-sectional side elevation view more particularly illustrating the non-rotational coupling the retaining flaps with respect to the rod.

In some embodiments, a front housing flange 114 may extend rearward from and along the upper edge of the front housing panel 112, between the housing side panels 106. In some embodiments, the front housing flange 114 may be parallel to the housing bottom panel 104, as best shown in FIG. 3. An internal space 116 may be formed by and between the housing bottom panel 104, the housing side panels 106, the front housing panel 112 and the front housing flange 114. The internal space 116 ends in a top opening 117. As best shown in FIG. 8, the front housing panel 112 is preferably not parallel to the housing attachment flanges 108 but rather tilted forward or outward at an angle, for purposes that will be hereinafter explained. While a planar front housing panel 112 is preferred, alternative embodiments are contemplated in which the forwardly arranged front housing panel 112 is not planar, but rather presents one or more concavities, convexities, protuberances, recesses, textures, or the like without departing from the scope of the present disclosure.

The housing bottom panel 104, housing side panels 106, front housing panel 112 and front housing flange 114 are configured to fully block light from passing therethrough, for instance and without limitation by being manufactured from an opaque or light-blocking material such as aluminum or other lightweight metal, plastic or a combination thereof, or by being provided with a light-blocking surface finish such as an opaque paint. Preferably, the housing bottom panel 104, housing side panels 106, front housing panel 112 and front housing flange 114 are also configured to block air from passing therethrough from outside the deflector housing 102 into the internal space 116 and vice versa.

Figure 7:
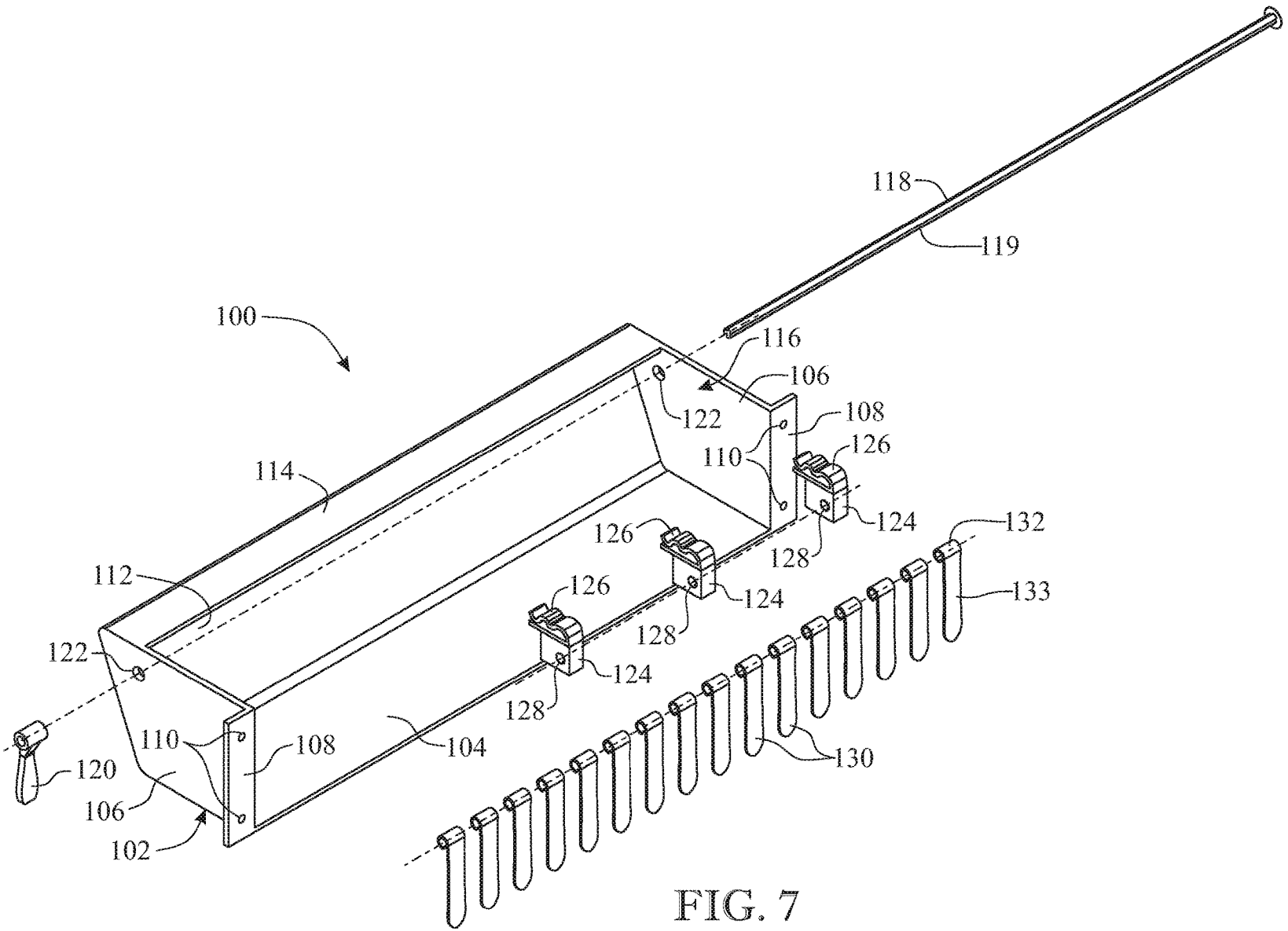
FIG. 7 presents an exploded, top rear perspective view of the air deflector.

An elongated beam, bar or rod 118 may be mounted for rotation within the internal space 116 of the deflector housing 102 according to the knowledge of those skilled in the art. The rod 118 may extend in the transverse direction x. As illustrated in FIG. 7, in some embodiments, a pair of registering through openings 122 may extend through the respective housing side panels 106. The ends of the rod 118 may be mounted in the respective through openings 122, relative rotation being provided between the ends of the rod 118 and the housing side panels 106. A user-operable handle 120 may be provided at one or both ends of the rod; for instance, the embodiment illustrated herein includes a user-operable handle 120 engaging one end of the rod 118 which protrudes beyond the housing side panel 106 to the exterior of the deflector housing 102. As shown in FIG. 2, the user-operable handle 120 (or handles) can be arranged outside of the deflector housing 102 such that the user-operable handle 120 is accessible by a user when the air deflector 100 is installed on a wall 12. The purpose of the user-operable handle 120 will be hereinafter described.

Figure 5:
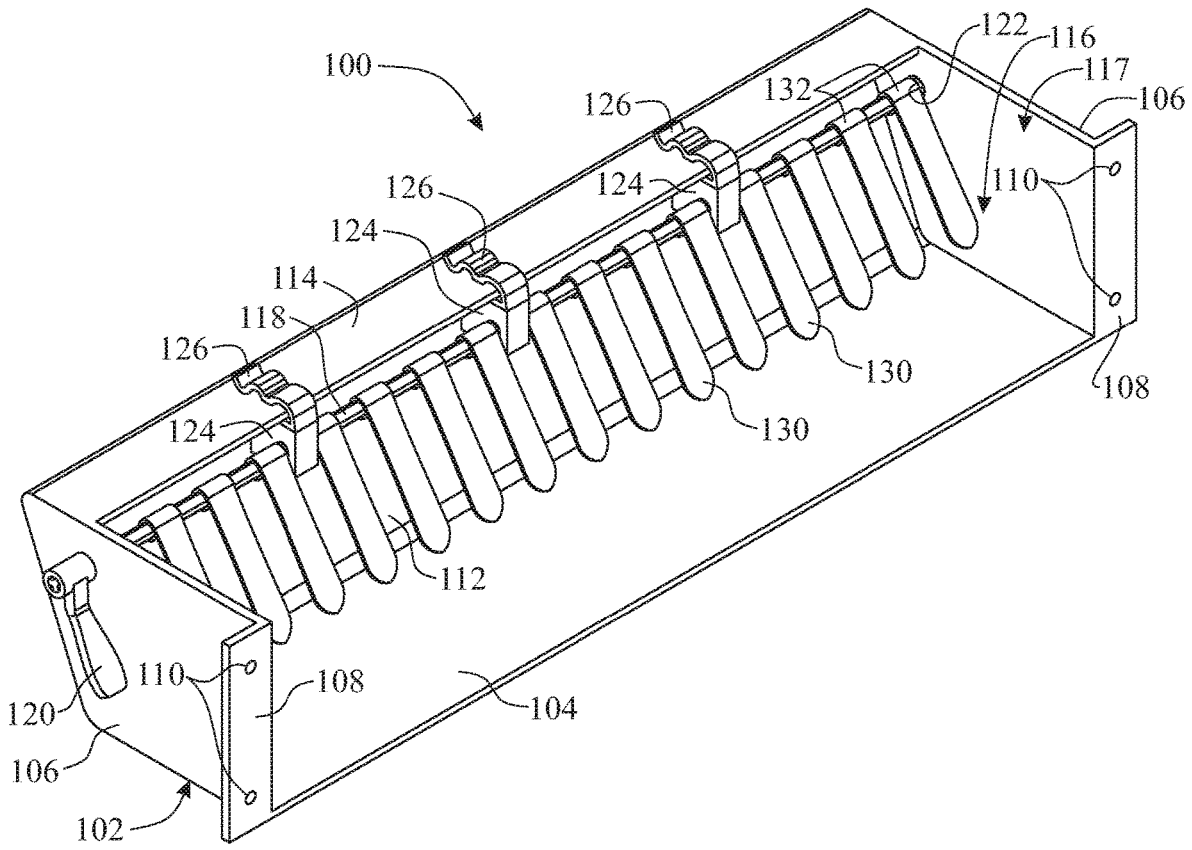
FIG. 5 presents a top rear perspective view of the air deflector with the retaining flaps shown in a second rotational position in the internal space.
Figure 6:
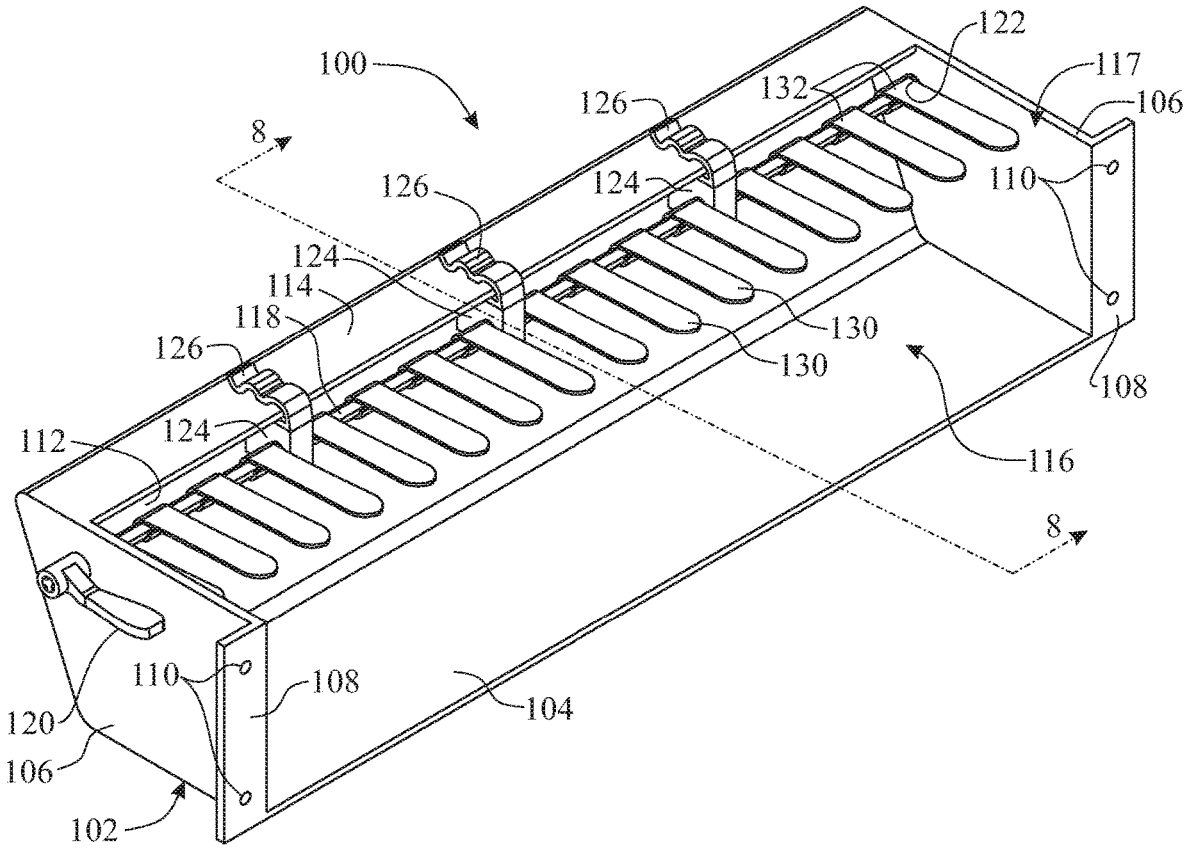
FIG. 6 presents a top rear perspective view of the air deflector with the retaining flaps shown in a third rotational position in the internal space.

As further shown in FIGS. 4 through 8, multiple retaining, radial protrusions may be mounted on the rod 118, extending radially from the rod 118. For instance, in the present embodiment, the radial protrusions are formed as flaps 130. The retaining flaps 130 are arranged in a spaced-apart relationship at preferably constant intervals. Each retaining flap 130 may include a rod sleeve 132 through which the rod 118 extends, and a flap body 133 extending perpendicular to the rod 118. As illustrated in FIG. 8, in some embodiments, at least one groove 119 may be provided longitudinally in the exterior surface of the rod 118 and facing radially outward from the rod 118. At least one internal protuberance 134 may extend radially inward from the interior surface of the rod sleeve 132. The one or more internal protuberances 134 are configured to be inserted in corresponding one or more grooves 119 of the rod 118 to retain the rod sleeve 132 in non-rotating relationship to the rod 118 so that the rod 118 and retaining flaps 130 are jointly rotatable relative to the housing side panels 106. As illustrated in FIGS. 4 through 6, the rod 118 can be rotated at various positions to orient the retaining flaps 130 at various angles within the internal space 116 of the deflector housing 102, typically by manipulation of the user-operable handle 120 on one end of the rod 118. In the different rotational positions of the retaining flaps 130, the retaining flaps 130 are oriented towards the rear side of the deflector housing 102, i.e. towards the rear end of the deflector housing 102 which is configured to be attached to the wall 12.

As further illustrated in FIGS. 7 and 8, in some embodiments, at least one rod holder 124 may be supported by the front housing flange 114 of the deflector housing 102. Each rod holder 124 may be attached to the front housing flange 114 according to the knowledge of those skilled in the art. For instance, in some embodiments such as the embodiment depicted herein, a clip fastener 126 may be provided on the rod holder 124. The clip fastener 126 may engage the front housing flange 114 to detachably secure each rod holder 124 to the deflector housing 102. A transverse, through opening 128 may extend through each rod holder 124. The rod 118 extends through the through opening 128 of each rod holder 124, and is rotatable in relation to the rod holders 224. The rod holders 124 contribute to support and secure the rod 118 within the internal space 116 of the deflector housing 102.

Referring next to FIGS. 2 and 3, in typical application, the air deflector 100 is installed on the wall 12 above the AC unit 10 and beneath the curtains 30 in a hotel or motel room or other lodging room or the like. For this purpose, the deflector housing 102 of the present embodiment is mounted to the wall 12 by attaching the housing attachment flanges 108 to the wall 12 using suitable fasteners (not illustrated) such as screws, hook-and-loop fasteners, adhesive tape or the like. The bottom ends 32 of the curtains 30 are inserted through the top opening 117 of the deflector housing 102 and inserted in the internal space 116 of the deflector housing 102. The curtains 30 are suspended, such as forming frontward and rearward undulations 34, defining frontward gaps or spaces 36 therebetween. The position of the retaining flaps 130 in the internal space 116 is adjusted by rotating the rod 118, typically by manipulation of the user-operable handle 120 (FIG. 4), so that the retaining flaps 130 rest against the curtains 30; for example, in the present application, the retaining flaps 130 become arranged within the frontward gaps or spaces 36 in between the successive undulations 34. The retaining flaps 130 are thus arranged at or near an outer or front side 38 of the curtains 30 facing the room, where each two consecutive retaining flaps 130 embrace or retain one forwardly directed undulation 34.

As mentioned heretofore, the retaining flaps 130 are rotatable in relation to the deflector housing 102. Depending on the length and distance between the curtains 30 and the wall 12 or the width of the opening between the curtains 30, the retaining flaps 130 may be positioned in a discrete or continuous variety of orientations, as illustrated a way of example in FIGS. 4 through 6. Thus, as illustrated in FIG. 3, the retaining flaps 130 can be suitably positioned to optimally engage the undulations 34 of the curtains 30 as mentioned above, and maintain the curtains 30 in a proximate or closed position with respect to the window 14 while the retaining flaps 130 retain the bottom ends 32 of the curtains 30 within the internal space 116.

As best shown in FIG. 3, when the AC unit 10 is operated and air 40 is blown upward and optionally forward through the outlet vent 11 of the AC unit 10, air 40 is directed toward the outward- or frontward-angled front housing panel 112. Because the front housing panel 112 is tilted frontward or outward, the front housing panel 112 reflects the air 40 and causes the air 40 to change its upward flow to a forward flow, as depicted by the curved arrows of FIG. 3. In other words, the frontward- or outward-angled front housing panel 112 directs the air 40 from the outlet vent 11 of the AC unit 10 away from the curtains 30. The housing bottom panel 104 further contributes to block air 40 from impacting the bottom end 32 of the curtains 30. In turn, light 50, and particularly bottom rays of light 51 passing through the bottom of the window 14 that may enter the internal space 116 of the deflector housing 102, as shown in FIG. 3, are retained within the deflector housing 102 by the bottom end 32 of the light-blocking curtains 30 and by the light-blocking housing bottom panel 104, housing side panels 106, front housing panel 112 and front housing flange 114 (i.e. by the deflector housing 102). Thus, the air deflector 100 deflects and prevents air 40 which flows in an upward trajectory from the AC unit 10 into the room from blowing the curtains 30 forwardly or outwardly from the wall 12 and the window 14, while the air deflector 100 and the curtains 30 are able to block light 50 which is transmitted through the window 14 from outside the room. The air deflector 100 therefore successfully prevents light 50 from entering the room when the AC unit 10 is in operation.

Figure 9:
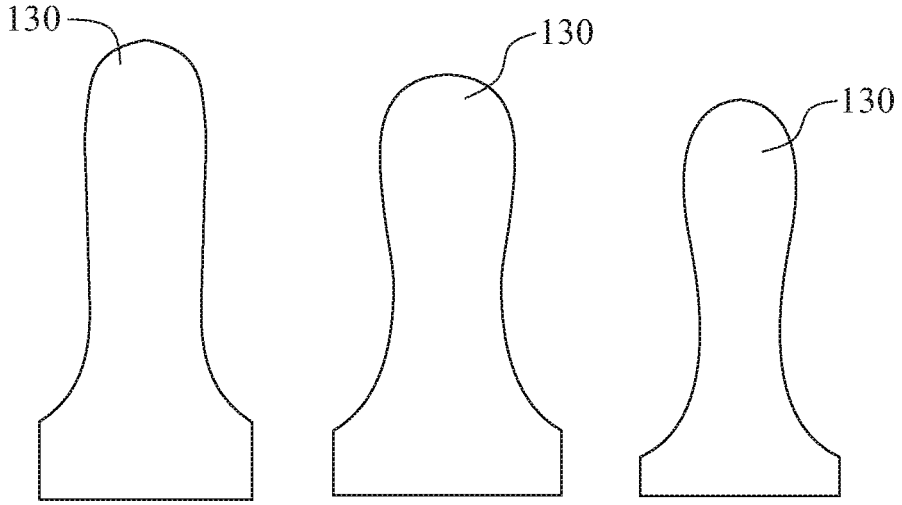
FIG. 9 presents a front view of three different-sized retaining flaps.

In alternative embodiments, the size and/or shape of the retaining flaps 130 may vary in order to adjust to different curtain or panel shapes or draping configurations. The illustration of FIG. 9, for instance, shows three exemplary retaining flaps 130 of variable shape and size, which may be used alone or combined when assembling the air deflector 100.

Figure 10:
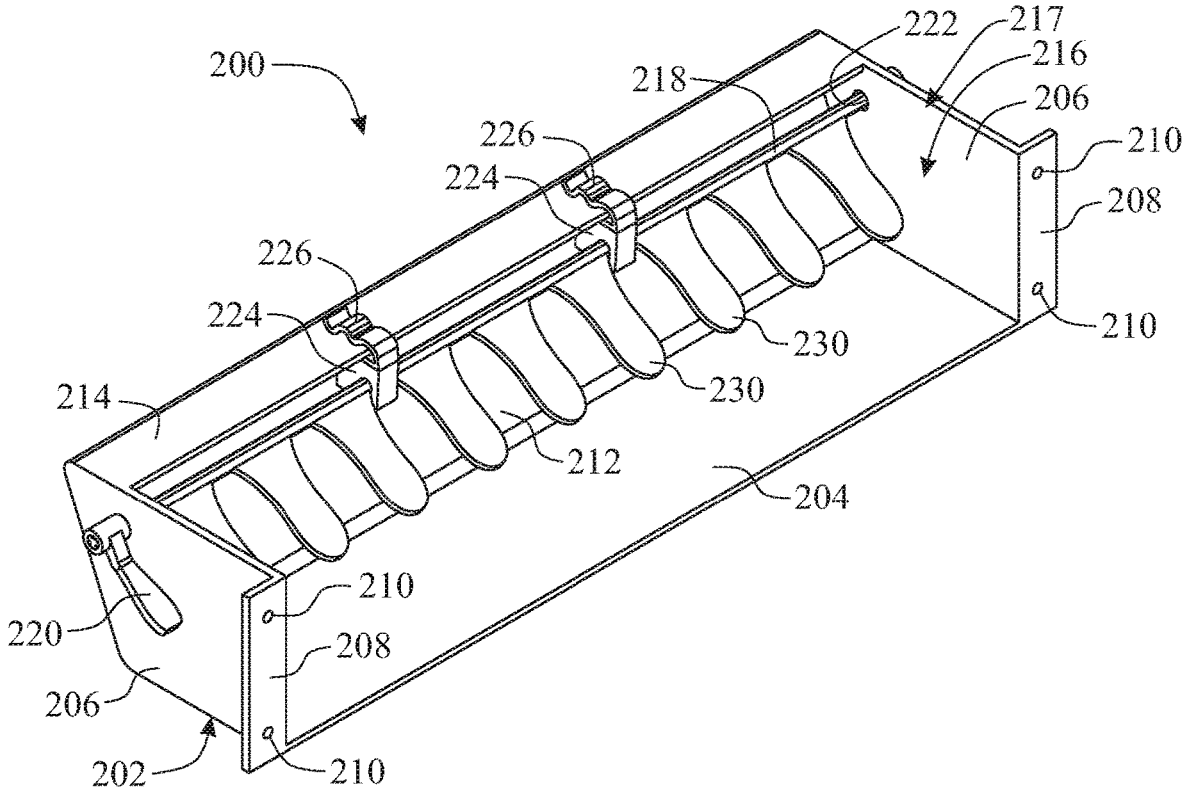
FIG. 10 presents a top rear perspective view of an air deflector in accordance with a second exemplary embodiment of the invention, having retaining flaps integrally formed with the rod.
Figure 11:
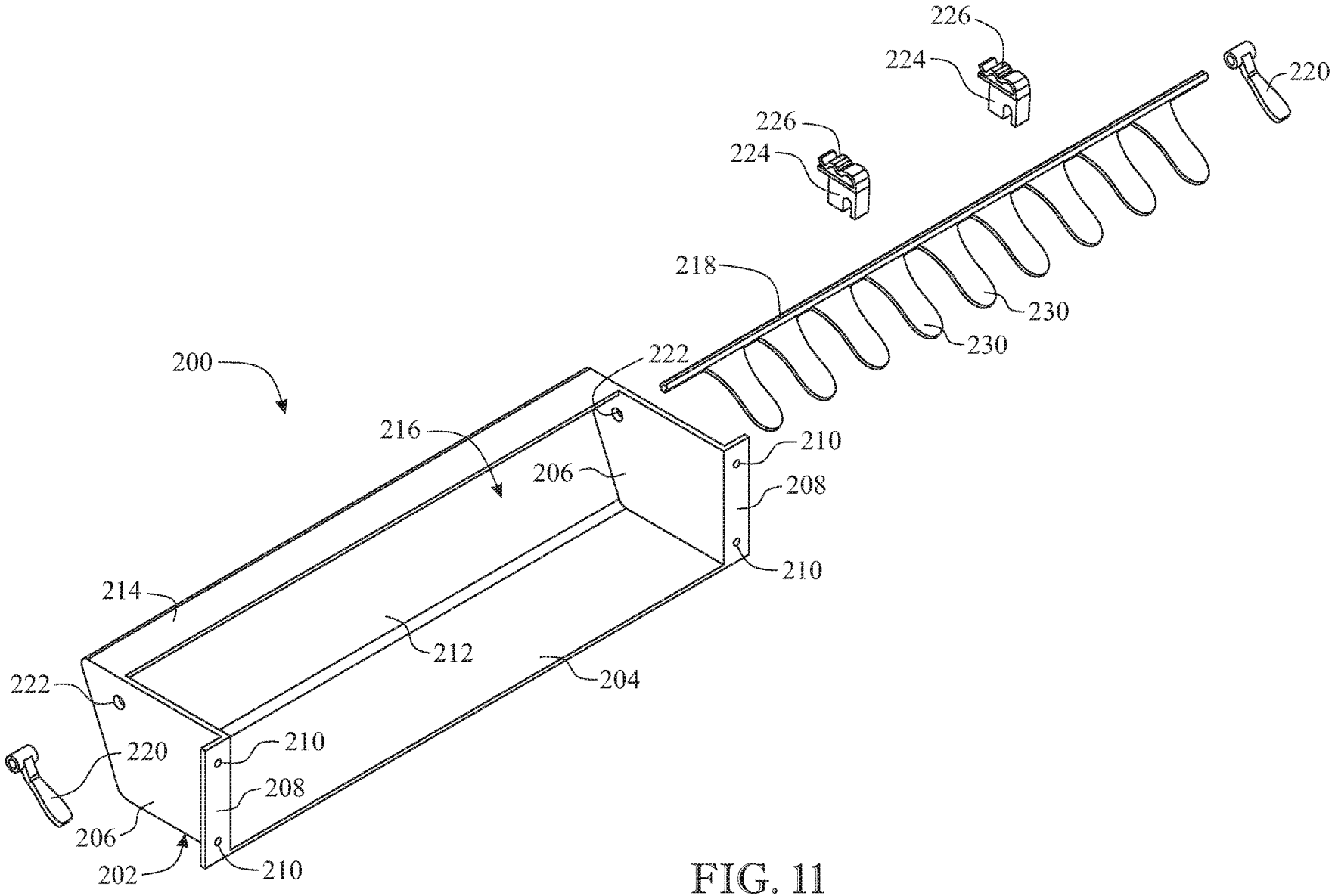
FIG. 11 presents an exploded, top rear perspective view of the air deflector of FIG. 10.

Referring next to FIGS. 10 and 11 of the drawings, an alternative illustrative embodiment of the air deflector is generally indicated by reference numeral 200. In the air deflector 200, elements which are analogous to the respective elements of the air deflector 100 that was heretofore described with respect to FIGS. 2 through 9 are designated by the same numeral in the 200 series in FIGS. 10 and 11. In the air deflector 200, the retaining flaps 230 are integrally formed with the rod 218 using casting, molding and/or other suitable fabrication techniques known by those skilled in the art. In addition, as shown, the rod holders 224 clip onto the rod 218 from above, the rod 218 being rotatable in relation to the rod holders 224 and the housing side panels 206. Application of the air deflector 200 may be as was heretofore described with respect to the air deflector 100 in FIGS. 2 through 9.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A drapery-holding, light-blocking air deflector comprising:

an opaque, elongated deflector housing comprising a rear side configured to be attached to a wall, an opaque bottom, an opaque front and opaque side walls delimiting an internal space of the deflector housing, wherein the deflector housing and internal space are elongately formed along a left-to-right, transverse direction and the internal space terminates in an elongate top opening extending along the transverse direction, wherein the deflector housing further comprises a front housing flange extending rearward from the opaque front and adjacent to the elongate top opening;

a rod mounted along the transverse direction for rotation within the internal space of the deflector housing about a longitudinal axis of the rod;

at least one retaining radial protrusion mounted on the rod, wherein the at least one retaining radial protrusion can be rotationally arranged at multiple rotational positions in relation to the longitudinal axis of the rod with the at least one retaining protrusion oriented towards the rear side of the deflector housing and at different angles with the elongate top opening in said multi pie rotational positions; and at least one rod holder, wherein each rod holder is clipped to the front housing flange of the deflector housing and comprises a through opening through which the rod extends to additionally secure the rod in the internal space of the deflector housing.

2. The air deflector of claim 1, wherein the deflector housing is configured to adopt an assembled position in which the rear side of the deflector housing is attached to a wall and the top opening is oriented upward for receiving a bottom end of a hanging drapery therethrough and inside the internal space of the deflector housing, and further in which the at least one retaining radial protrusion is rotationally adjusted to a rotational position in which the at least one retaining radial protrusion contacts the bottom end of the hanging drapery to limit or prevent a frontward movement of the bottom end of the hanging drapery relative to the rear side of the deflector housing.

3. The air deflector of claim 1, wherein an outer surface of the opaque front of the deflector housing is sloped forward to reflect air impacting the deflector housing from below such that said air is reflected frontward of the deflector housing.

4. The air deflector of claim 1, wherein the deflector housing comprises a housing bottom panel providing the opaque bottom, housing side panels extending from the housing bottom panel and providing the opaque side walls, and a front housing panel extending from the housing bottom panel between the housing side panels and providing the opaque front.

5. The air deflector of claim 4, wherein the front housing panel is sloped frontward to reflect air coming from beneath the front housing panel in a frontward direction.

6. The air deflector of claim 4, wherein the rod is mounted for rotation between the housing side panels of the deflector housing.

7. The air deflector of claim 1, further comprising a user-operable handle connected to the rod and arranged outside the deflector housing to facilitate manual rotation of the rod and positioning of the at least one retaining radial protrusion in any of the multiple rotational positions within the internal space of the deflector housing.

8. The air deflector of claim 1, wherein the rear side of the deflector housing comprises a pair of housing attachment flanges extending transversely from opposite ends of the rear side and configured to rest on a wall.

9. The air deflector of claim 8, wherein each housing attachment flange comprises at least one fastener opening extending through each of the housing attachment flanges.

10. The air deflector of claim 1, wherein the at least one retaining radial protrusion comprises a plurality of radial protrusions extending radially outward from the rod in a spaced-apart relationship with one another along a direction parallel to the longitudinal axis of the rod.

11. The air deflector of claim 10, wherein the radial protrusions are aligned with one another along a direction parallel to the longitudinal axis of the rod.

12. The air deflector of claim 1, wherein the at least one retaining radial protrusion is a flap.

13. The air deflector of claim 1, wherein the at least one retaining radial protrusion is integrally formed with the rod into a single-piece unit.

14. The air deflector of claim 1, wherein each retaining radial protrusion of the at least one radial protrusion comprises a rod sleeve through which the rod extends to mount said each retaining radial protrusion on the rod.

15. The air deflector of claim 14, wherein the rod sleeve is mounted on the rod in a non-rotational relationship with the rod by insertion of at least one internal protuberance extending from the rod sleeve into at least one respective groove formed longitudinally in the rod.

16. The air deflector of claim 1, wherein the front housing flange is opaque and further delimits the internal space of the deflector housing.

17. A drapery-holding, light-blocking air deflector comprising:

an opaque, elongated deflector housing comprising a rear side configured to be attached to a wall, an opaque bottom, a forward-sloped opaque front and opaque side walls delimiting an internal space of the deflector housing, wherein the deflector housing and internal space are elongately formed along a left-to-right, transverse direction and the internal space terminates in an elongate top opening extending along the transverse direction, wherein the deflector housing further comprises a front housing flange extending rearward from the opaque front and adjacent to the elongate top opening;

a rod mounted along the transverse direction for rotation within the internal space of the deflector housing about a longitudinal axis of the rod;

at least one retaining radial protrusion mounted on the rod, wherein the at least one retaining radial protrusion can be rotationally arranged at multiple rotational positions in relation to the longitudinal axis of the rod with the at least one retaining protrusion oriented towards the rear side of the deflector housing and at different angles with the elongate top opening in said multiple rotational positions; and at least one rod holder, wherein each rod holder is clipped to the front housing flange of the deflector housing and comprises a through opening through which the rod extends to additionally secure the rod in the internal space of the deflector housing; wherein the deflector housing is configured to adopt an assembled position in which the rear side of the deflector housing is attached to a wall and the top opening is oriented upward for receiving a bottom end of a hanging drapery therethrough and inside the internal space of the deflector housing, and further in which the at least one retaining radial protrusion is rotationally adjusted to a rotational position in which the at least one retaining radial protrusion contacts the bottom end of the hanging drapery to limit or prevent a frontward movement of the bottom end of the hanging drapery relative to the rear side of the deflector housing, and in which the forward-sloped front of the deflector housing reflects air impacting the deflector housing from beneath such that the air is directed frontward of the deflector housing.

* * * * *